US011771933B2

(12) United States Patent
Selvan et al.

(10) Patent No.: US 11,771,933 B2
(45) Date of Patent: Oct. 3, 2023

(54) FIRE SENSOR, APPARATUS AND SYSTEM

(71) Applicant: Airbus (S.A.S.), Blagnac (FR)

(72) Inventors: Arumugam Thinket Selvan, Filton (GB); Prakash Hatti, Filton (GB)

(73) Assignee: Airbus SAS, Blagnac (FR)

( * ) Notice: Subject to any disclaimer, the term of this patent is extended or adjusted under 35 U.S.C. 154(b) by 1198 days.

(21) Appl. No.: 16/216,260

(22) Filed: Dec. 11, 2018

(65) Prior Publication Data

US 2019/0184217 A1 Jun. 20, 2019

(30) Foreign Application Priority Data

Dec. 12, 2017 (IN) ..... 201741044614

(51) Int. Cl.
*A62C 3/08* (2006.01)
*G08B 17/06* (2006.01)

(52) U.S. Cl.
CPC ..... *A62C 3/08* (2013.01); *G08B 17/06* (2013.01)

(58) Field of Classification Search
CPC ..... G02B 6/4457; A62C 3/08; G08B 17/06; G08B 17/107; G01D 5/12; G01D 5/16; G01K 11/32; G01N 33/0036
See application file for complete search history.

(56) References Cited

U.S. PATENT DOCUMENTS 4,979,796 A * 12/1990 Cardarelli ..... G02B 6/4457 385/123
7,810,577 B2 10/2010 Popp et al.
8,075,181 B1 * 12/2011 Stauffer ..... A61B 5/015 607/101
2005/0089081 A1 * 4/2005 Dammann ..... B64D 45/00 374/161
2011/0243515 A1 * 10/2011 Bradley ..... G02B 6/443 385/113

(Continued)

FOREIGN PATENT DOCUMENTS

CN 202 013 625 U 10/2011
CN 105218779 B * 4/2018 ..... C08G 18/384

(Continued)

OTHER PUBLICATIONS

Ballato et al., "Glass and Process Development for the Next Generation of Optical Fibers: A Review," Fibers, vol. 5, No. 11, pp. 1-25, dated Mar. 10, 2017.

(Continued)

*Primary Examiner* — Lisa M Caputo
*Assistant Examiner* — Janice M Soto
(74) *Attorney, Agent, or Firm* — KDW Firm PLLC

(57) ABSTRACT

A fire sensor, fire sensing apparatus and a fire sensing system are disclosed. The fire sensor includes a layer of fibers arranged to cross one another at intersections. The fibers have an electromagnetic property which is changeable upon contact with fire and they are individually connectible to a detector of fire sensing apparatus to detect any change in the electromagnetic property. A change in electromagnetic property detected at any intersection of two fibers will indicate a fire at the location of that intersection. A movement of that location across the sensor will indicate the direction of travel of the fire. The sensing system is capable of sending alerts and extinguishing the fire.

20 Claims, 7 Drawing Sheets

(56) References Cited

U.S. PATENT DOCUMENTS

| | | | | |
|---|---|---|---|---|
| 2015/0053431 | A1* | 2/2015 | Graham | A62C 37/08<br>169/61 |

FOREIGN PATENT DOCUMENTS

| | | | | |
|---|---|---|---|---|
| EP | 3246681 | A1 | | 11/2017 |
| EP | 3246683 | A1 | | 11/2017 |
| JP | 57113329 | A | * | 7/1982 |
| JP | 09119872 | A | * | 5/1997 |
| WO | WO 2015/199590 | A1 | | 12/2015 |
| WO | WO 2016/092293 | A1 | | 6/2016 |

OTHER PUBLICATIONS

Extended European Search Report for Application No. 18208228.9 dated May 15, 2019.
Combined Search and Examination Report for Great Britain Application No. GB1801456.3 dated Aug. 15, 2018.

* cited by examiner

FIRE SENSOR, APPARATUS AND SYSTEM

CROSS-REFERENCE TO RELATED APPLICATION

This application claims priority to Indian Patent Application No. 201741044614 filed Dec. 12, 2017, the entire disclosure of which is incorporated by reference herein.

TECHNICAL FIELD

The disclosure herein relates to a fire sensor, apparatus and system to deter the spread of fire.

BACKGROUND

It is known to provide a fire resistant material such as a fire resistant blanket to deter the spread of fire in an environment. It is also known to provide fire seals to prevent the spread of fire from a fire zone on a vehicle or in other environments. On aircraft, in particular, various fire zones are difficult to monitor for fire, critical to prevent the spread of fire or both.

An example of an area which has been found susceptible to fires and where it is both difficult and expensive to monitor for fire is the cabin attic area of an aircraft. The area is hidden from view and thermal insulation blankets/films can burn undetected until a large area is damaged or until the burning area falls within the detection range of fire/smoke detectors.

Fire and smoke detectors and the complex network of wiring harness required for these add considerable unwanted weight and complexity to the aircraft.

Examples of areas on the aircraft where it is critical to prevent the spread of fire are engines, pylon ribs with fuel lines, pylon to engine interfaces and pylon to wing interfaces. In such areas, fire seals are used to prevent the spread of fire.

It is an object of the disclosure herein to provide a fire sensor which will reduce the difficulties associated with the prior art.

SUMMARY

According to a first aspect of the disclosure herein, there is provided a fire sensor including a fiber, the fiber having an electromagnetic property changeable upon contact with fire and being connectible to a detector to detect any the change in electromagnetic property, whereby a change in electromagnetic property detected in the fiber will indicate a fire at a location of that fiber.

The fire sensor may include a layer of the fibers arranged to cross one another at intersections, the fibers being individually connectible to the detector to detect any the change in electromagnetic property, whereby a the change in electromagnetic property detected at an intersection of two fibers will be indicative of a fire at the location of that intersection.

The at least one fiber may comprise a non-conductive core material which is preferably doped in a conducting agent. The conducting agent may comprise a nano material which may comprise a graphene-based doping agent. The graphene-based doping agent may comprise graphene oxide.

The core material is preferably non-flammable and may conveniently comprise a glass fiber or a polyvinyl fluoride fiber.

A changeable electromagnetic property may conveniently comprise one of the group consisting of electrical resistance and surface magnetism, but may comprise any suitable electromagnetic property.

The fire sensor may include a substrate to which the at least one fiber is attached.

For any desired environment but for aircraft and other vehicles in particular, the substrate may comprise a thermal insulation blanket or a fire seal.

The fire seal may comprise elastomeric material including a layer of fire resistant reinforcement. Additionally, friction combatting lubricant may be added to promote easy sliding of the seal.

According to a second aspect of the disclosure herein, there is provided fire sensing apparatus including a fire sensor according to the first aspect and a detector, the detector including a transmitter to send a test signal to a first end of the at least one fiber of the fire sensor, a receiver to receive the test signal from a second end of the at least one fiber and an analyzer to analyze the received signal and thereby detect any change in electromagnetic property of the at least one fiber.

The analyzer may be adapted or configured to detect any change in electromagnetic property of the at least one fiber by comparing a received test signal with a stored test signal corresponding to an unburnt fiber and then indicating a fire if the test signal varies from the stored signal in a predetermined manner.

The apparatus may include a display to display the location of a detected fire for an observer.

According to a third aspect of the disclosure herein, there is provided an aircraft fire alarm system including fire sensing apparatus according to the second aspect and an alarm. The fire alarm system may include a fire control system including one or more fire extinguisher(s), device or system.

According to a fourth aspect of the disclosure herein, there is provided an aircraft including fire sensing apparatus according to the second aspect or a fire alarm system according to the third aspect.

BRIEF DESCRIPTION OF THE DRAWINGS

The disclosure herein will now be described, by way of example only, with reference to the following, example drawings, in which.

DETAILED DESCRIPTION

Figure 1:
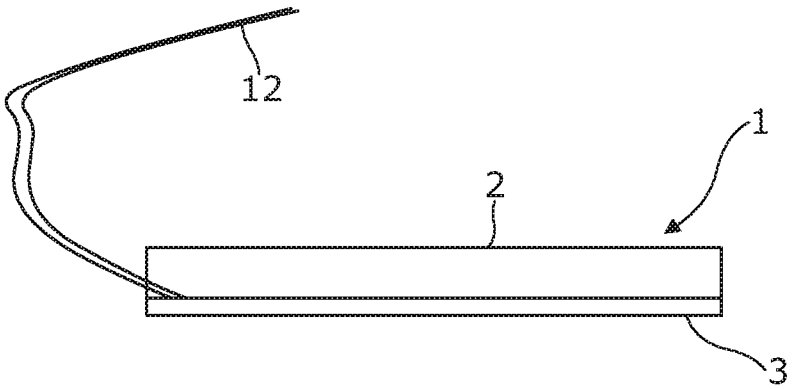
FIG. 1 is a schematic representation of a fire sensor according to the disclosure herein in the form of a thermal insulation blanket.
Figure 8:
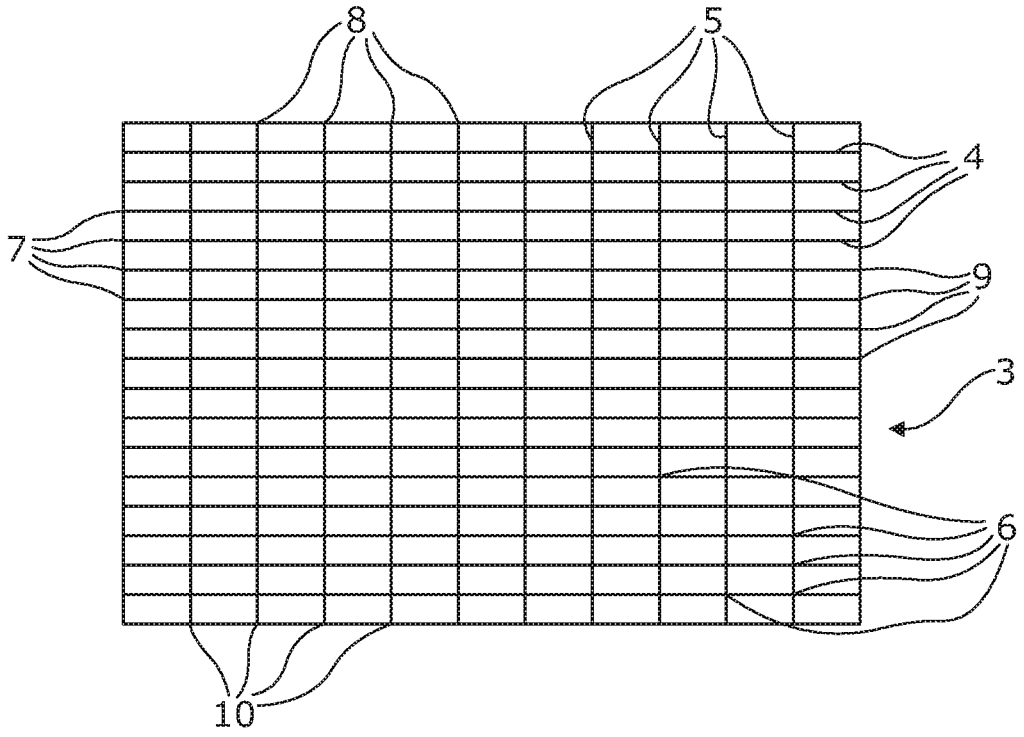
FIG. 8 shows schematically orthogonal fibers of a fire sensor according to the disclosure herein.

FIGS. 1 and 8 show a fire sensor according to the disclosure herein in the form of a thermal insulation blanket 1. The blanket 1 comprises a conventional layer 2 of glass fiber matting and a fire detection layer 3 according to the disclosure herein of graphene oxide doped glass fibers 4, 5 passing in orthogonal directions. The fibers 4, 5 have intersections 6 which are used to pinpoint locations of any fire detected on the sensor. It should be understood that the intersections 6 allow no electrical contact between fibers 4, 5 but merely represent positions on the sensor at which fire is deemed to exist if the two fibers 4, 5 form an intersection there. Connections are made from fiber ends 7, 8, 9, 10 to separate the detector incorporated into a controller 11 (see FIGS. 5 and 6). From the fire detection layer 3 extend nominal connections 12 to the controller 11. Such connections 12 will, in practice, include connections from all fibers 4, 5 in the fire detection layer 3.

On an aircraft, in practice, such fire sensors on thermal insulation blankets will be deployed in a cabin attic area and will thus provide a fire retardant effect via the blanket and fire warning via the fire sensor which is co-extensive with the blanket.

Figure 2A:
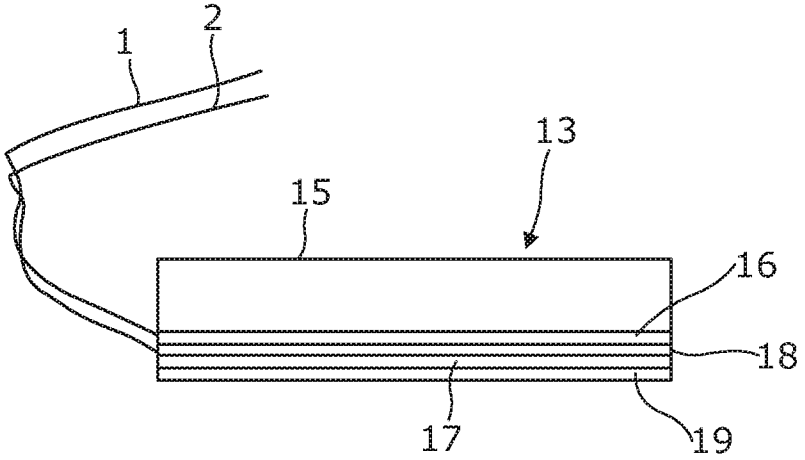
FIGS. 2A and 2B are schematic representations of a fire sensor according to the disclosure herein in the form of two configurations of fire seal.
Figure 2B:
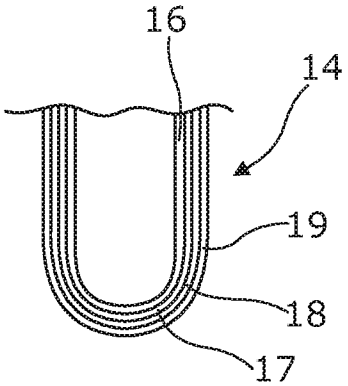

Referring to FIGS. 2A and 2B, there are shown, in section, two versions of a fire seal 13, 14, according to the disclosure herein. Fire seal 13 is a flat sheet in form and comprises a layer 15 of elastomeric material, here it is silicone rubber filled with high temperature stabilizing additives, two conventional layers 16, 17 of fire resistant reinforcement, for example, meta aramid, and two fire detection layers 18, 19 according to the disclosure herein. The fire detection layers 18, 19 comprise graphene oxide doped glass fabric, the glass being non-conductive by nature, and the outer fire detection layer 19 is treated with siloxane oil to reduce surface friction and may include intumescent particles (not shown here) to act as a first layer of fire containment. The graphene oxide has been chemically treated to improve its flame retardant properties.

In this example, the chemical treatment includes the addition of intumescent materials and foaming materials to the layer 19. Such treatment is carried out by techniques such as critical drying and chemical ageing.

FIG. 2B shows an alternative configuration of fire seal in the form of a lip seal 14. Lip seal 14 is similar in configuration to the seal 22 shown in FIGS. 3A, 3B and 3C, discussed below.

Figures 3A, 3B, 3C:
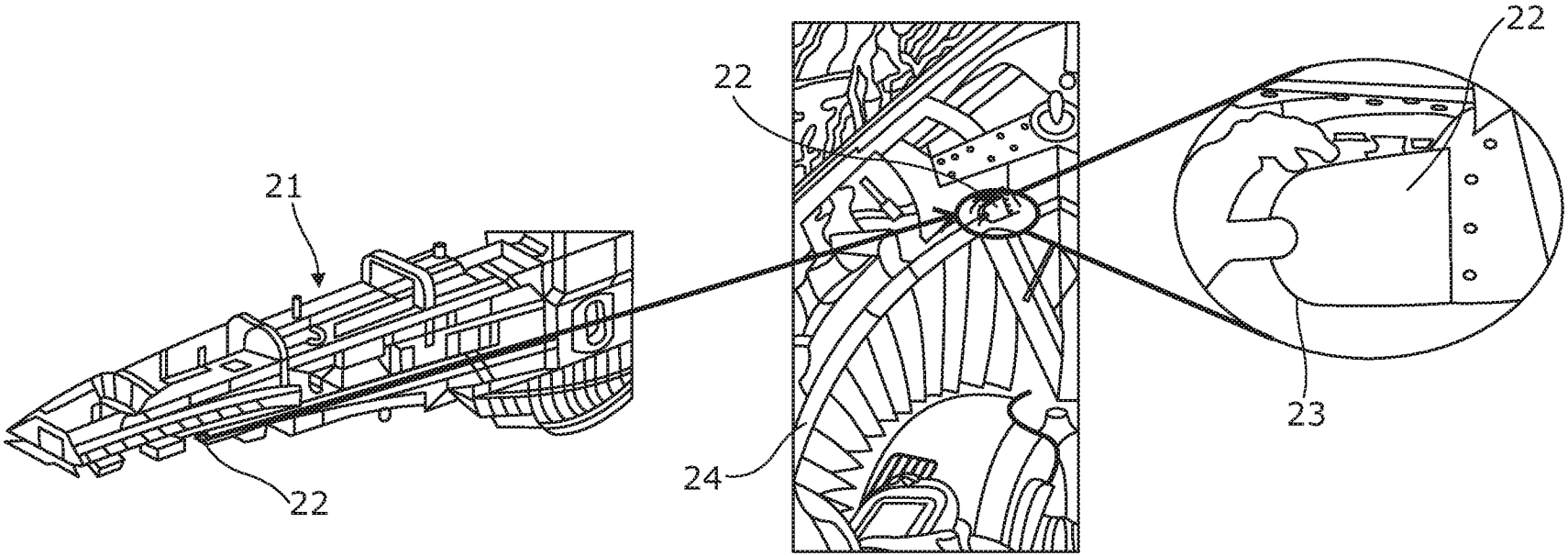
FIGS. 3A, 3B and 3C show an aircraft engine splitter seal in position.

An example of such a fire seal in use is shown in FIGS. 3A, 3B and 3C. Here, there is shown an aircraft engine pylon 21 on which is mounted an annular engine splitter fire seal 22 according to the disclosure herein. The fire seal 22 is manufactured according to the principles explained with reference to FIGS. 2A and 2B, although the details of the different layers are not shown. In use, curved portion 23 of the seal 22 bears against engine component 24 and creates a fire break.

Figure 4:
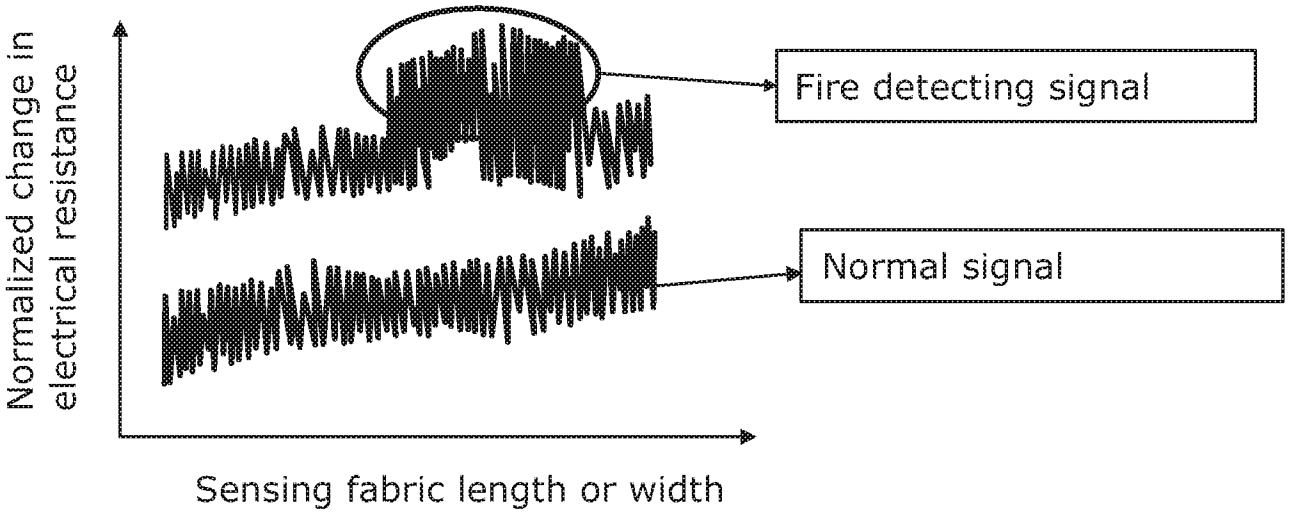
FIG. 4 is a graph showing normalized change in electrical resistance against fabric length or width for a fire sensor according to the disclosure herein.

Referring now to FIG. 4, there is shown a graph representing a signal sent to and received from a fire sensor according to the disclosure herein. The graph plots Sensing Fabric Length or Width against Normalized Change in Electrical Resistance. The lower trace, labelled "Normal signal", represents a test signal sent and received from multiple fibers across the fabric length or width. The fire sensor may be a thermal insulation blanket or a fire seal.

The upper trace, labelled "Fire detecting signal", represents a test signal sent to the same fabric. The shift in signal, as shown in the upper trace, indicates where the fire has been detected in that fabric. It will be seen that the upper trace is virtually identical with the lower trace until the 'fire detected' part of the signal, encircled, takes over. As the graph plots distance along or across the fabric, it is possible to determine where in the fabric the fire is detected.

In practice, the test signal received from the fiber can also be compared with a stored signal for that fiber or a similar fiber. Any difference above a given threshold can be used to determine the existence of a fire in the fiber or the presence of some other anomaly, such as a break in the fiber. This system may be used for continuous monitoring of fibers/fabric and also for calibration of the apparatus.

A similar comparison can be made between test signals sent to adjacent fabrics/fire blankets in order to determine whether a detected fire has spread to the adjoining fabric as well.

Figure 7:
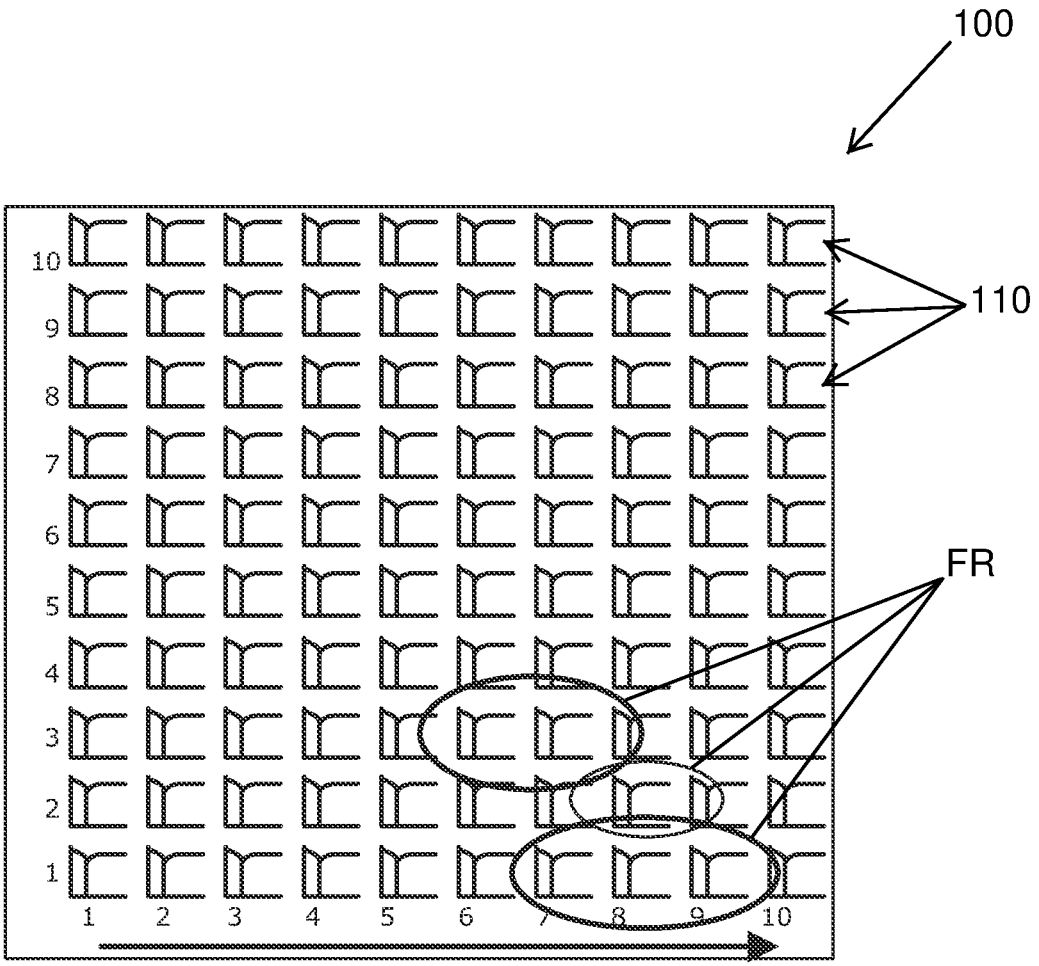
FIG. 7 shows, schematically, sensor connections on a microchip used to indicate flame position on the fire sensor.

Turning now to FIG. 7, this shows, schematically, sensor connections, generally designated 110, on a microchip, generally designated 100, used to indicate presence or absence of a flame on the fire sensor. Each of the 100 diagrams in the grid represents a test signal received at one of the sensor connections 110 from a single fiber of a fire sensor according to the disclosure herein. The fibers represented at the sensor connections 110 show identical test signals received save for those encircled within regions FR, which show no signal or a modified signal, according to the specific design of the apparatus or system. The locations of those fibers with no signal or a modified signal will indicate where a fire exists in the fabric.

By this, the fire sensor, fire sensing apparatus and fire sensing system of the disclosure herein can detect where a fire is located on a single fabric or on a series of fabrics on an aircraft. In addition, flame propagation either travelling through various fiber intersections 6 (see FIG. 8) or from one fabric to the next can be detected, according to the disclosure herein.

Figure 5:
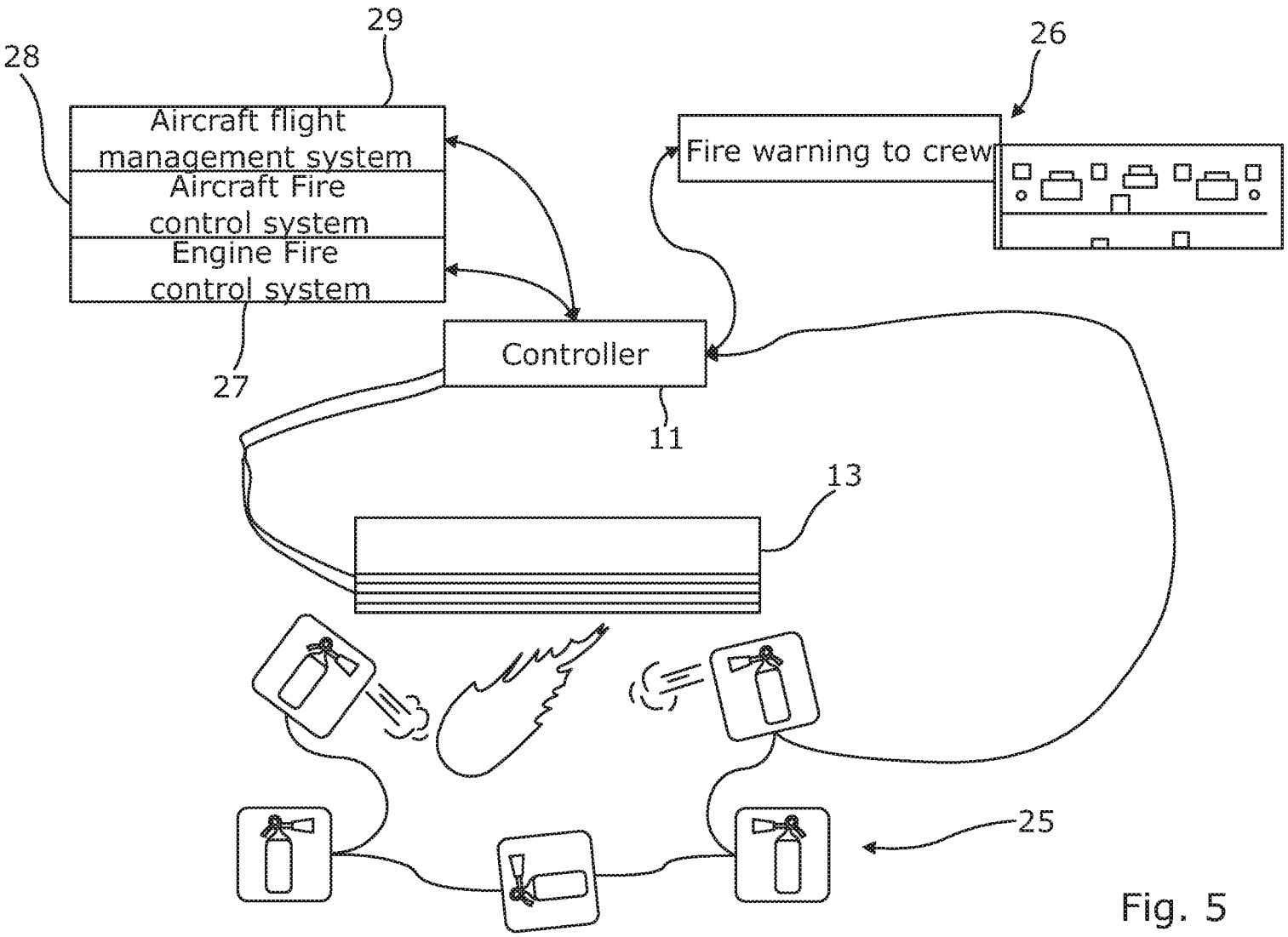
FIG. 5 shows schematically a fire sensing system according to the disclosure herein in use for active fire control.

FIG. 5 shows schematically a fire sensing system according to the disclosure herein in use for active fire control. Central to the system is a controller 11 of which further detail appears in FIG. 6. The controller 11 is connected to a fire seal 13 and fire extinguishers 25, distributed throughout the aircraft in order selectively to extinguish flames wherever detected by the fire sensors, according to the disclosure herein. In addition, the controller 11 is connected to a crew warning system 26, an engine fire control system 27, an aircraft fire control system 28 and an aircraft flight management system 29. In operation, when a fire is detected by the controller 11 in a fire sensor such as the fire seal 13, it communicates with the flight management system 29, the aircraft fire control system 28, the engine fire control system 27 and an aircraft air system (not shown) to give and receive information relating to the general state of the aircraft and to the fire(s) detected. The controller 11 then selectively activates the appropriate number of fire extinguishers 25 to dowse the fire. Extinguishing is stopped once the fire sensors no longer indicate the presence of a fire to the controller 11. In addition, the controller sends a continuously updating alert to the crew 26 as to the current state of the fire(s).

Figure 6:
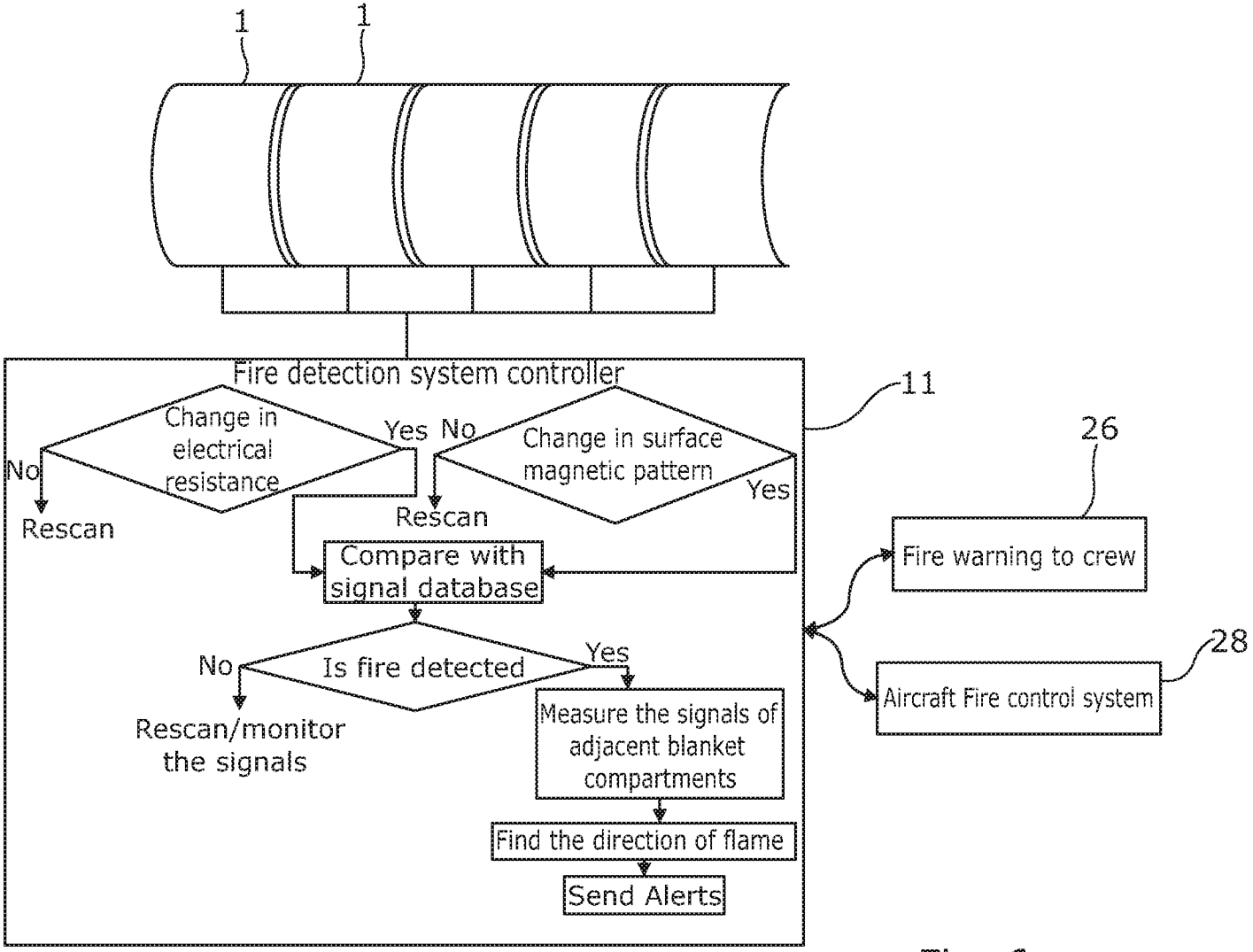
FIG. 6 shows schematically the fire sensing system of FIG. 5 with a decision tree used by the controller shown in FIG. 5.

FIG. 6 shows detail of the decision-making used in the controller 11 when a fire is detected in one of the fire blankets 1.

The embodiments described herein are respective non-limiting examples of how the disclosure herein and aspects of the disclosure herein may be implemented. Any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the disclosure herein, which is defined by the accompanying claims.

The subject matter disclosed herein can be implemented in software in combination with hardware and/or firmware. For example, the subject matter described herein can be implemented in software executed by a processor or processing unit. In one exemplary implementation, the subject matter described herein can be implemented using a computer readable medium having stored thereon computer executable instructions that when executed by a processor of a computer control the computer to perform steps. Exemplary computer readable mediums suitable for implementing the subject matter described herein include non-transitory devices, such as disk memory devices, chip memory devices, programmable logic devices, and application specific integrated circuits. In addition, a computer readable medium that implements the subject matter described herein can be located on a single device or computing platform or can be distributed across multiple devices or computing platforms.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A fire sensor in a form of a thermal insulation blanket, the fire sensor comprising:
- a glass fiber matting layer; and
- a fire detection layer attached on the glass fiber matting layer, the fire detection layer comprising:
  - a plurality of first fibers; and
  - a plurality of second fibers;
  - wherein the plurality of first fibers and the plurality of second fibers are arranged to cross one another at a plurality of intersections, respectively;
  - wherein each of the plurality of first fibers are not in electrical contact with any of the plurality second fibers at all of the plurality of intersections;
  - wherein each of the plurality of first fibers and each of the plurality of second fibers have an electromagnetic property changeable upon contact with fire;
  - wherein each of the plurality of first fibers and each of the plurality of second fibers are individually connectible to a same detector of a fire sensing apparatus to detect a change in the electromagnetic property thereof; and
- wherein detection of the change in electromagnetic property for a first fiber of the plurality of first fibers that intersects a second fiber of the plurality of second fibers is indicative of a fire at a location of one of the plurality of intersections where the first fiber and the second fiber intersect with one another.

2. The fire sensor according to claim 1, wherein:
- at least one first fiber of the plurality of first fibers comprises a non-conductive core material doped in a conducting agent; and/or
- at least one second fiber of the plurality of second fibers comprises the non-conductive core material doped in the conducting agent.

3. The fire sensor according to claim 2, wherein the conducting agent comprises a nano material.

4. The fire sensor according to claim 3, wherein the nano material comprises a graphene-based doping agent.

5. The fire sensor according to claim 4, wherein the graphene-based doping agent comprises graphene oxide.

6. The fire sensor according to claim 2, wherein the core material is non-flammable.

7. The fire sensor according to claim 1, wherein the electromagnetic property comprises electrical resistance and/or surface magnetism.

8. A fire sensing apparatus comprising:
- a detector; and
- a fire sensor in a form of a thermal insulation blanket, the fire sensor comprising:
  - a glass fiber matting layer; and
  - a fire detection layer attached on the glass fiber matting layer, the fire detection layer comprising:
    - a plurality of first fibers; and
    - a plurality of second fibers;
    - wherein the plurality of first fibers and the plurality of second fibers are arranged to cross one another at a plurality of intersections, respectively; and
    - wherein each of the plurality of first fibers are not in electrical contact with any of the plurality second fibers at all of the plurality of intersections;
    - wherein each of the plurality of first fibers and each of the plurality of second fibers have an electromagnetic property changeable upon contact with fire;
    - wherein each of the plurality of first fibers and each of the plurality of second fibers is individually connected to the detector to detect a change in the electromagnetic property thereof; and
    - wherein detection of the change in electromagnetic property for a first fiber of the plurality of first fibers that intersects a second fiber of the plurality of second fibers is indicative of a fire at a location of one of the plurality of intersections where the first fiber and the second fiber intersect with one another;
- wherein the detector comprises:
  - a transmitter configured to send a test signal to a first end of one or more first fibers of the plurality of first fibers and to a first end of one or more second fibers of the plurality of second fibers;
  - a receiver configured to receive the test signal from a second end of the one or more first fibers and from a second end of the one or more second fibers; and
  - an analyzer configured to analyze the test signal received by the receiver for detecting when the change in electromagnetic property of the one or more first fibers and of the one or more second fibers occurs.

9. The fire sensing apparatus according to claim 8, wherein the analyzer is configured to detect the change in electromagnetic property of the one or more first fibers and of the one or more second fibers by comparing the test signal received by the receiver with a stored test signal corresponding to an unburnt fiber and then indicating a fire when the test signal received by the receiver varies from the stored signal.

10. The fire sensing apparatus according to claim 9, comprising a display configured to display a location of a detected fire.

11. An aircraft comprising a fire sensing apparatus according to claim 8.

12. An aircraft fire alarm system comprising:

a fire sensing apparatus according to claim 8; and an alarm.

13. The aircraft fire alarm system according to claim 12, comprising a fire extinguisher.

14. An aircraft comprising a fire alarm system according to claim 12.

15. A fire sensor in a form of a fire seal, the fire sensor comprising:

a first fire detection layer comprising a plurality of first fibers;

a second fire detection layer comprising a plurality of second fibers;

a first fire resistant reinforcement layer positioned between the first fire detection layer and the second fire detection layer, such that the first fire detection layer is spaced apart from the second fire detection layer by a thickness of the first dire resistant reinforcement layer;

a second fire resistant reinforcement layer positioned on the second fire detection layer, on an opposite side of the second fire detection layer from the first fire resistant reinforcement layer; and wherein the plurality of first fibers and the plurality of second fibers are arranged to cross one another at a plurality of intersections, respectively;

wherein each of the plurality of first fibers are physically separated from each of the plurality second fibers at all of the plurality of intersections by the first fire resistant reinforcement layer;

wherein each of the plurality of first fibers and each of the plurality of second fibers have an electromagnetic property changeable upon contact with fire;

wherein each of the plurality of first fibers and each of the plurality of second fibers are individually connectible to a same detector of a fire sensing apparatus to detect a change in the electromagnetic property thereof; and wherein detection of the change in electromagnetic property for a first fiber of the plurality of first fibers that intersects a second fiber of the plurality of second fibers is indicative of a fire at a location of one of the plurality of intersections where the first fiber and the second fiber intersect with one another.

16. The fire sensor according to claim 15, comprising a layer of elastomeric material positioned on the second fire resistant reinforcement layer, so as to form an outer surface of the first seal.

17. The fire sensor according to claim 16, wherein the fire seal is in a form of a flat sheet and the layer of elastomeric material comprises silicone rubber.

18. The fire sensor according to claim 17, wherein the first fire detection layer is an outer surface of the fire sensor, opposite the outer surface formed by the layer of elastomeric material, the first fire detection layer being treated with siloxane oil for reducing surface friction and comprising intumescent particles as a first layer of fire containment.

19. The fire sensor according to claim 18, wherein the first fire detection layer and the second fire detection layer each comprise a respective glass fabric that is doped with graphene oxide that is chemically treated to improve flame retardant properties of the graphene oxide.

20. The fire sensor according to claim 15, wherein:

the fire seal is in a form of an annular engine splitter fire seal, such that the fire sensor has a U-shaped profile, the annular engine splitter fire seal being configured for mounting on an aircraft engine pylon; and the first fire detection layer is an outer surface of the annular engine splitter fire seal and is configured to bear against an engine component of an aircraft engine to create a fire break.

* * * * *